US006454254B2

(12) United States Patent
Yamaguchi et al.

(10) Patent No.: US 6,454,254 B2
(45) Date of Patent: Sep. 24, 2002

(54) SHEET MOUNTING APPARATUS

(75) Inventors: Kouzou Yamaguchi, Kashihara; Hidenobu Mandai, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/814,933

(22) Filed: Mar. 23, 2001

(30) Foreign Application Priority Data

Mar. 23, 2000 (JP) ..... 2000-082881

(51) Int. Cl.[7] ..... B65H 1/00
(52) U.S. Cl. ..... 271/171
(58) Field of Search ..... 271/171, 240, 271/241, 265.01

(56) References Cited

U.S. PATENT DOCUMENTS 5,076,562 A * 12/1991 Sai et al. ..... 271/171
5,332,209 A * 7/1994 Romansky et al. ..... 271/171

FOREIGN PATENT DOCUMENTS

JP 63-0185730 * 8/1988 ..... 271/171
JP 404045017 A * 2/1992 ..... 271/171
JP 405043058 * 2/1993 ..... 271/171
JP A717640 1/1995

* cited by examiner

*Primary Examiner*—H. Grant Skaggs

(57) ABSTRACT

The invention allows an amount by which restricting members should be moved to be grasped accurately and easily, prohibits movement of the restricting members in time of fastening the restricting members, and allows positions of the restricting members to be adjusted accurately and just by a necessary amount. A set screw is meshed with a boss of a retaining member through an eccentric cam mounted in a cam guide formed in an upper surface of a main body, the eccentric cam being supported to have an axis of rotation aligned to an axis of rotation of a pinion. A rotation of the eccentric cam varies positions of contact between peripheral surface of the eccentric cam and side surfaces of the cam guide to vary a distance from the positions of contact to the center of rotation of the eccentric cam.

6 Claims, 9 Drawing Sheets

SHEET MOUNTING APPARATUS

BACKGROUND OF THE INVENTION

1. Field of the Invention

The present invention relates to a sheet mounting apparatus attachable to sheet processing apparatus including an image-forming apparatus such as a copier, printer or facsimile machine, for holding sheets to be fed to a predetermined position in the sheet processing apparatus. More particularly, the invention relates to a sheet mounting apparatus for mounting a variety of sizes of sheets on a sheet mounting plate.

2. Description of the Related Art

Generally, with a sheet processing apparatus such as an image-forming apparatus for continuously performing a predetermined process for a plurality of objects in sheet form, the sheets must be fed successively to a predetermined position in the apparatus. For this purpose, the sheet processing apparatus has a sheet mounting apparatus such as a sheet feed cassette or sheet feed tray for storing a plurality of sheets. The sheet mounting apparatus has restricting members for restricting the movement of sheets in a direction perpendicular to a sheet feeding direction, and stores a plurality of sheets of the same size.

On the other hand, some sheet processing apparatuses are constructed to process plural types of sheets having different sizes. A sheet mounting apparatus applicable to such a sheet processing apparatus must determine a sheet position in the direction perpendicular to the sheet feeding direction for each of the plurality of sizes. Thus, the restricting members may be set to positions corresponding to each sheet size. Particularly where sheets are fed to the sheet processing apparatus with reference to a middle position in the direction perpendicular to the sheet feeding direction, and when the sheets to be fed are changed from one size to another, the right and left restricting members in the sheet mounting apparatus must be moved by the same amount in opposite directions.

A sheet processing apparatus which selectively performs processes for sheets of different sizes may accept a plurality of sheet mounting apparatuses for storing the different size sheets. Where sheets of a different size are fed from each sheet mounting apparatus, all the sheet mounting apparatuses must have a common reference position in the direction perpendicular to the sheet feeding direction. Otherwise, the processing position in the sheet processing apparatus would be varied for each size of the sheets. It would then be impossible to process the sheets in a proper position.

Where a plurality of sheet mounting apparatuses are attached to a conventional sheet processing apparatus, the position in the sheet processing apparatus to which each sheet mounting apparatus is attached, or the positions of restricting members in each sheet mounting apparatus, is/are adjustable in order to secure for all the sheet mounting apparatuses a precisely uniform reference position in the direction perpendicular to the sheet feeding direction.

However, a conventional sheet mounting apparatus requires an operation to adjust the position in the sheet processing apparatus to which the sheet mounting apparatus is attached, or adjust the positions of restricting members in the sheet mounting apparatus. This operation is carried out by loosening fastening devices of the restricting members with a tool, then moving the sheet mounting apparatus or the restricting members, relying on eye measurement, and tightening the fastening devices with the tool. Thus, a necessary amount of movement of the sheet mounting apparatus or the restricting members cannot be grasped accurately. The sheet mounting apparatus or the restricting members could move in time of tightening the fastening devices. It is difficult to secure a precisely uniform position for feeding sheets from a plurality of sheet mounting positions. The adjusting operation needs to be repeated, thereby requiring an extended operating time.

A plurality of sheet mounting apparatuses attachable to a sheet processing apparatus include the type that can detect and/or indicate a size of sheets stored, based on the positions of restricting members. However, when the positions of the restricting members are adjusted in the sheet mounting apparatus, an error could occur in the size detection or indication. Then, the sheet processing apparatus would misrecognize the size of sheets stored in the sheet mounting apparatus. There also occurs a discrepancy between the size indicated by the sheet mounting apparatus and the size of sheets stored thereon.

SUMMARY OF THE INVENTION

An object of the present invention is to provide a sheet mounting apparatus which allows an amount by which a restricting section should be moved to be grasped accurately and easily, prohibits movement of the restricting section in time of fastening the restricting section, allows positions of the restricting section to be adjusted accurately and just by a necessary amount, allows an operation for adjusting a sheet feed position to be carried out easily and in a short time, and produces no error in size detection or indication due to movement of the restricting section.

To achieve the above-mentioned object, the invention provides a sheet mounting apparatus comprising:

- a main body for mounting a variety of sizes sheets on a sheet mounting plane;
- a restricting section movable to the main body in a first direction which is parallel to the sheet mounting plane of the main body and perpendicular to a second direction which is a sheet feeding direction, according to a size of sheets on the sheet mounting plane, for restricting movement of the sheets;
- a reference position regulating section for regulating a reference position of the restricting section in the first direction; and
- an adjusting section for selectively moving the reference position regulating section to one of a plurality of positions in the first direction.

In the above construction according to the invention, the reference position regulating section for regulating the reference position of the restricting section which restrict movement of the sheets in the first direction is moved by the adjusting section selectively to one of a plurality of positions in the first direction. Thus, when the reference position regulating section moves to one of the plurality of positions in the first direction, the reference position of the restricting section shifts in the first direction. In this way, the reference position is adjusted easily and accurately.

According to the invention, the reference position regulating section for regulating the reference position of the restricting section which restrict movement of the sheets in the first direction is moved by the adjusting section selectively to one of the plurality of positions in the first direction, the reference position of the restricting section is shifted in the first direction, to adjust the reference position easily and accurately. As a result, an operation to adjust a sheet feed position can be carried out easily and in a short time.

In the invention it is preferable that the reference position regulating section is a rotatable element rotatable with movement of the restricting section, and movable relative to the main body within a predetermined range in the first direction; and the adjusting section includes an eccentric cam which is supported coaxially with the rotatable element to be placed selectively in one of a plurality of rotational positions and has a peripheral surface contacting side surfaces of a cam guide formed in the main body, which side surfaces extend parallel to the second direction.

In this construction according to the invention, the position of the rotatable element in the first direction varies with the distance from the center of rotation of the eccentric cam to positions of contact between the peripheral surface of the eccentric cam and the side surfaces of the cam guide extending parallel to the second direction. Thus, when the eccentric cam is rotated to a predetermined rotational position, the reference position of the restricting section shifts in the first direcion. The reference position is adjusted easily and accurately only by the rotation of the eccentric cam.

According to the invention, the eccentric cam is rotated to a predetermined rotational position by varying the position of the rotatable element in the first direction based on the distance from the center of rotation of the eccentric cam to the positions of contact between the peripheral surface of the eccentric cam and the side surfaces of the cam guide extending parallel to the second direction. This results in a shift of the reference position of the restricting section in the direction perpendicular to the second direction. The reference position is thus adjusted easily and accurately only by the rotation of the eccentric cam.

In the invention it is preferable that the adjusting section includes a control member which is disposed below an upper surface of a sheet mount of the main body so as to be operated from the upper surface side of the sheet mount, and fixed to an upper surface of the eccentric cam to be coaxial with the axis of rotation of the cam.

In this construction according to the invention, the control member operable to rotate the eccentric cam is disposed so as to be operated from the upper surface side of the sheet mount, without contacting the bottom of a lowermost sheet of the sheets stacked on the sheet mounting plane. Thus, an operation to adjust the reference position of the restricting section in the first direction is carried out easily from above the sheet mount, with the control member not interfering with sheet feeding.

According to the invention, with the control member operable to rotate the eccentric cam and disposed so as to be operated from the upper surface side of the sheet mount, without contacting the bottom of the lowermost sheet of the sheets stacked on the sheet mounting plane, an operation to adjust the reference position of the restricting section in the first direction can be carried out easily from above the sheet mount, and the control member does not interfere with sheet feeding.

In the invention it is preferable that the reference position regulating section is a rotatable element rotatable with movement of the restricting section, and movable relative to the main body within a predetermined range in the first direction; and the adjusting section includes a screw meshed with a support portion of the rotatable element in the first direction to be placed selectively in one of a plurality of rotational positions.

In this construction according to the invention, the position in the first direction of the support portion of the rotatable element which regulates the reference position of the restricting section varies with the rotational position of the screw. Thus, when the screw is rotated to a predetermined rotational position, the reference position of the restricting section shifts in the first direction. The reference position is adjusted easily and accurately only by the rotation of the screw.

According to the invention, the screw is rotated to vary the position in the first direction of the support portion of the rotatable element which regulates the reference position of the restricting section. By rotating the screw to a predetermined rotational position, the reference position of the restricting section can be shifted in the first direction. Thus the reference position can be adjusted easily and accurately only by the rotation of the screw.

In the invention it is preferable that the adjusting section includes a control member which is disposed so as to be operated from a side surface side of a sheet mount of the body, and fixed to one end of the screw to be coaxial with the screw.

In this construction according to the invention, the control member operable to rotate the screw is disposed so as to be operated from the side surface side of the sheet mount. Thus, an operation to adjust the reference position of the restricting section in the first direction is carried out outside the sheet mount, without requiring the sheets to be removed from the sheet mount.

According to the invention, with the control member operable from the side surface side of the sheet mount to rotate the screw, an operation to adjust the reference position of the restricting section in the first direction can be carried out outside the sheet mount easily. The sheets need not be removed from the sheet mount in time of the adjusting operation.

In the invention it is preferable that the apparatus further comprises a size indicator movable in the same direction and by the same amount as those of the reference position regulating section, for indicating positions of ends of the sheets on the sheet mount of the main body in the first direction.

In this construction according to the invention, the size indicator is movable in the same direction and by the same amount as those of the reference position regulating section regulating the reference position of the restricting section. Thus, after the reference position of the restricting section is shifted, the reference position and size indicator remain in the same positional relationship, whereby a sheet position on the sheet mount is indicated accurately.

According to the invention, by moving the size indicator in the same direction and by the same amount as those of the reference position regulating section regulating the reference position of the restricting section, the positional relationship between the reference position and size indicator remains unchanged even after the reference position of the restricting section is shifted. Consequently, a sheet position on the sheet mount can be indicated accurately at all times.

In the invention it is preferable that the apparatus further comprises a size detector movable in the same direction and by the same amount as those of the reference position regulating section, for detecting positions of the restricting section on a sheet mount of the main body in the first direction.

In this construction according to the invention, the size detector is movable in the same direction and by the same amount as the reference position regulating section regulating the reference position of the restricting section. Thus, after the reference position of the restricting section is shifted, the reference position and size detector remain in the same positional relationship, whereby the size of sheets placed on the sheet mount is detected accurately.

According to the invention, by moving the size detector in the same direction and by the same amount as those of the reference position regulating section regulating the reference position of the restricting section, the positional relationship between the reference position and size detector remains unchanged even after the reference position of the restricting section is shifted. Consequently, the size of sheets placed on the sheet mount can be detected accurately at all times.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
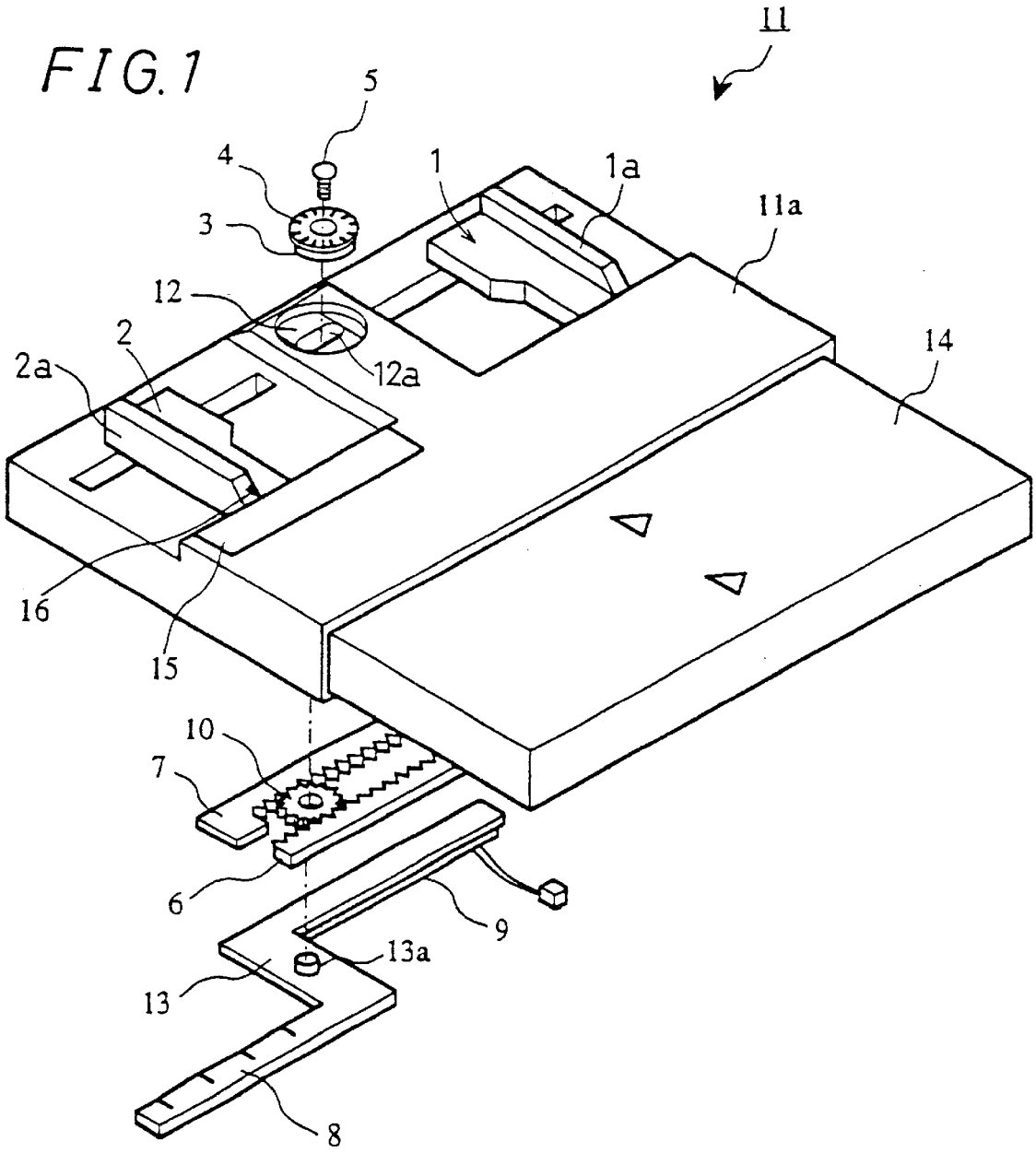
FIG. 1 is a perspective view of a sheet mounting apparatus in a first embodiment of the invention.

Now referring to the drawings, preferred embodiments of the invention are described below.

FIG. 1 is a perspective view of a sheet mounting apparatus in a first embodiment of the invention. This sheet mounting apparatus 11 is a sheet feed tray attachable to a side of a sheet processing apparatus such as a copier or a printer. The sheet mounting apparatus 11 includes, as a sheet mount, a main body 11*a*, and an extension member 14 extendible and retractable relative to the main body 11*a*. The sheet mounting apparatus 11 further includes a pair of restricting members 1, 2 to be described hereinafter. The extension member 14 is movable relative to the main body 11*a* at an end opposite to the end of the main body 11*a* attached to the side of the sheet processing apparatus, to vary the length of the sheet mount in a second direction which is a sheet feeding direction parallel to a sheet mounting plane. The extension member 14 is drawn from the main body 11*a* when feeding sheets of large sizes such as A4 size and B4 size.

The main body 11*a* has, mounted on an upper surface thereof, a size display 15 with indices indicating positions of side edges of different size sheets extending parallel to the second direction. By placing a mark 16 shown on one of the restricting members 2 in register with an index shown in the size display 15, the restricting members 1, 2 are set to positions for contacting side edges, extending perpendicular to the second direction, of sheets of a selected size. The construction of the size display 15 will be described hereinafter.

The restricting members 1, 2 include restricting portions 1*a*, 2*a* and racks 6, 7, respectively. FIG. 1 shows the restricting portions 1*a*, 2*a*, and racks 6, 7 separated from each other to facilitate illustration. The restricting portions 1*a*, 2*a* project from the upper surface of the main body 11*a* and are arranged such that a sheet mounting position on the sheet mount serves as a middle sheet feed reference, to restrict movement of the sheets in a first direction which is perpendicular to the sheet feeding direction and parallel to the sheet mounting plane. The restricting portions 1*a*, 2*a* are movable within a predetermined range in the first direction. The racks 6, 7 are attached to lower positions of the restricting portions 1*a*, 2*a* such that, when the restricting members 1, 2 are attached to the main body 11*a*, the racks 6, 7 extend parallel to each other in the first direction adjacent the bottom of the main body 11*a*, with the teeth of racks 6, 7 opposed to each other with a predetermined spacing therebetween. A pinion 10 is rotatably supported by a bottom position of the main body 11*a*. The pinion 10 is disposed between and in engagement with the racks 6, 7. The racks 6, 7 and the pinion 10 constitute a reference position regulating section of the invention. The pinion 10 acts as the rotatable element.

When one of the restricting members 1 is moved on the main body 11*a*, for example, this movement is transmitted as a reversed movement through the racks 6, 7 and the pinion 10 to the other restricting member 2. As a result, the other restricting member 2 moves in the opposite direction to and by the same amount as the one restricting member 1. Even when the sizes of the sheets placed on the main body 11*a* are changed, the middle position in the first direction of the middle sheet feed reference is maintained. This applies also to the case of moving the other restricting member 2.

Since the racks 6, 7 attached to the restricting portions 1*a*, 2*a* are engaged with the pinion 10 which is rotatably supported by the main body 11*a*, by moving a supporting position of the pinion 10 in the main body 11*a* in the direction perpendicular to the sheet feeding direction, positions of the restricting members 1, 2 on the main body 11*a* in the first direction are shifted, and the reference position of the middle sheet feed reference is also shifted.

The pinion 10 is connected to the main body 11*a* by tightening a set screw 5 to a boss 13*a* of a retaining member 13. Specifically, the pinion 10 has a center bore for rotatably fitting to the boss 13*a* of retaining member 13 adjacent the bottom of the main body 11*a*. The set screw 5 extends downward through a slot 12*a* formed in the main body 11*a* and elongated in the first direction, and is meshed with the boss 13*a*. This determines a position of the boss 13*a* in the main body 11*a* to provide an axis of rotation of the pinion 10. Consequently, variations in the position of the set screw 5 penetrating the slot 12*a* of the main body 11*a* varies the supporting position of the pinion 10 in the main body 11*a*, and varies the positions of the restricting members 1, 2 in the main body 11*a* and the reference position of the middle sheet feed reference also.

In the sheet mounting apparatus 11 according to this embodiment, an eccentric cam 3 is disposed in a cam guide 12 formed in an upper portion of the main body 11*a*. The eccentric cam 3 has the same axis of rotation as the pinion 10. The set screw 5 is meshed with the retaining member 13 through the eccentric cam 3. With this construction, the position of the set screw 5 in the slot 12*a* is movable by a predetermined amount corresponding to an amount of rotation of the eccentric cam 3, to allow the reference position of the middle sheet feed reference to be adjusted easily and accurately. The eccentric cam 3 and the cam guide 12 to be described hereinafter constitute the adjusting section of the invention.

As a result, there is no need to repeat an operation, as practiced in the prior art, to vary the position of the boss 13*a* after loosening the set screw 5 from the boss 13*a*, feed sheets after tightening the set screw 5 to the boss 13*a*, and confirm a sheet processing position. An operation to adjust the reference position of the middle sheet feed reference can be carried out easily and in a reduced time.

Figure 2:
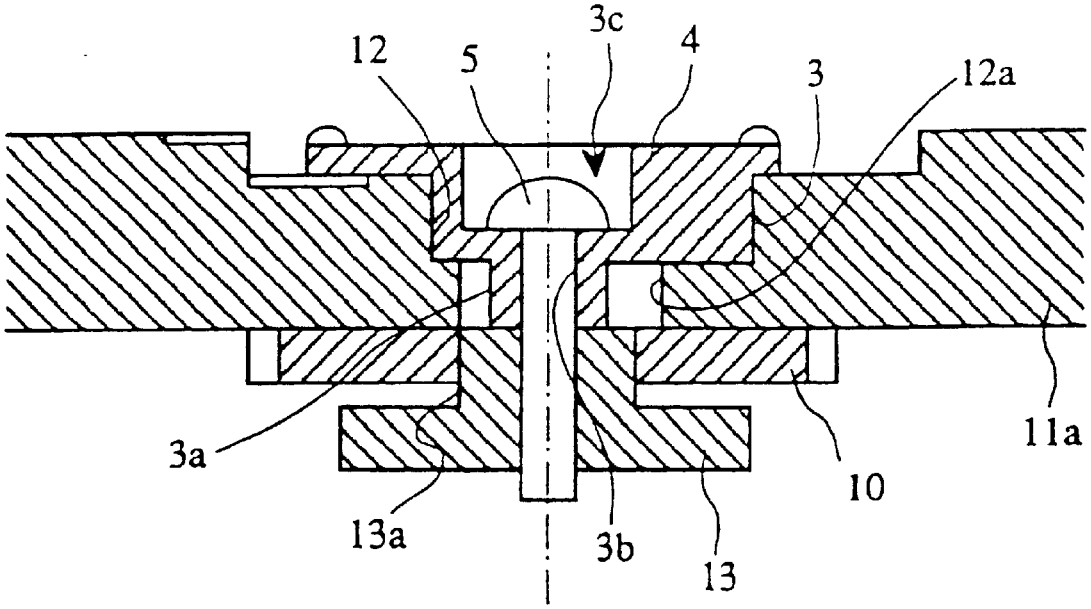
FIG. 2 is a sectional view of an adjusting section in the sheet mounting apparatus.

FIG. 2 is a sectional view showing the construction of the adjusting section in the above sheet mounting apparatus. The upper portion of the main body 11*a* for receiving the set screw 5 defines the cam guide 12 in the form of a rectangular recess. The bottom of cam guide 12 defines the slot 12*a* elongated in the first direction. The eccentric cam 3 fits into the cam guide 12 from above. A peripheral surface of the eccentric cam 3 comes into contact with two side surfaces 12*b*, 12*c* of the cam guide 12 extending parallel to the second direction, and a shaft portion 3*a* projecting from the bottom of the eccentric cam 3 lies in the slot 12*a*.

A flange-like adjusting dial 4 having a center recess 3*c* is integrated with an upper portion of the eccentric cam 3. The adjusting dial 4, acting as the control member of the invention, is disposed below the upper surface of the main body 11*a* so as to be operated therefrom. The shaft portion 3*a*, which has a center bore 3*b*, projects from the bottom of the eccentric cam 3. The set screw 5 extends through the recess 3*c* and the center bore 3*b* of the eccentric cam 3 fitted into the cam guide 12 from above the main body 11*a*, and is meshed with a threaded bore formed in the boss 13*a*. In this state, an end surface of the shaft portion 3*a* abuts on an end surface of the boss 13*a*. As a result, the main body 11*a* is held by the set screw 5 between the bottom of the adjusting dial 4 and the upper surface of the boss 13*a* to determine the supporting position in the main body 11*a* of the pinion 10 fitted to the boss 13*a*. In this state, the eccentric cam 3 is rotatable relative to the main body 11*a* about the axis of the bore 3*b* and the recess 3*c* which are penetrated by the set screw 5.

With the adjusting section having the above construction, when the eccentric cam 3 is rotated in the cam guide 12, variations occur with positions on the peripheral surface of the eccentric cam 3 contacting the side surfaces 12*b*, 12*c* of cam guide 12. The circular arc constituting the peripheral surface of the eccentric cam 3 is off set from the axis of rotation of the eccentric cam 3. Thus, varied distances exist from the center of rotation of the eccentric cam 3 to the positions on the peripheral surface thereof. With variations, caused by a rotation of the eccentric cam 3, in the positions of contact between the peripheral surface of the eccentric cam 3 and the side surfaces 12*b*, 12*c* of the cam guide 12 result in variations in the distance from the side surfaces 12*b*, 12*c* of the cam guide 12 to the center of rotation of the eccentric cam 3.

As noted hereinbefore, the center position of the bore 3*b* and the recess 3*c* which are the center of rotation of the eccentric cam 3 is aligned with the center position of the set screw 5 meshed with the boss 13*a*. The cam guide 12 is formed in the upper portion of the main body 11*a*, with the two side surfaces 12*b*, 12*c* extending parallel to the second direction which surfaces are contacted by the peripheral surface of the eccentric cam 3. Therefore, variations in the distance from the side surfaces of the cam guide 12 to the center of rotation of the eccentric cam 3 result in variations in the position, in the first direction, of the set screw 5 and the boss 13*a* in the main body 11*a*. As a result, variations occur also in the position in the main body 11*a*, in the first direction, of the pinion 10 fitted to the boss 13*a*, the racks 6, 7 engaged with the pinion 10 and the restricting members 1, 2 having the racks 6, 7.

Figure 3A:
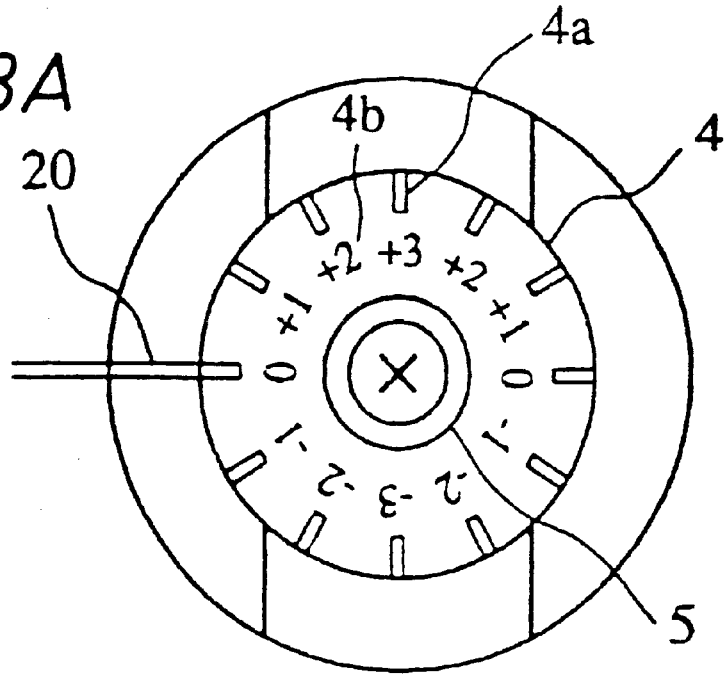
FIG. 3A is a plan view showing an amount of rotation of an adjusting dial.
Figure 3B:
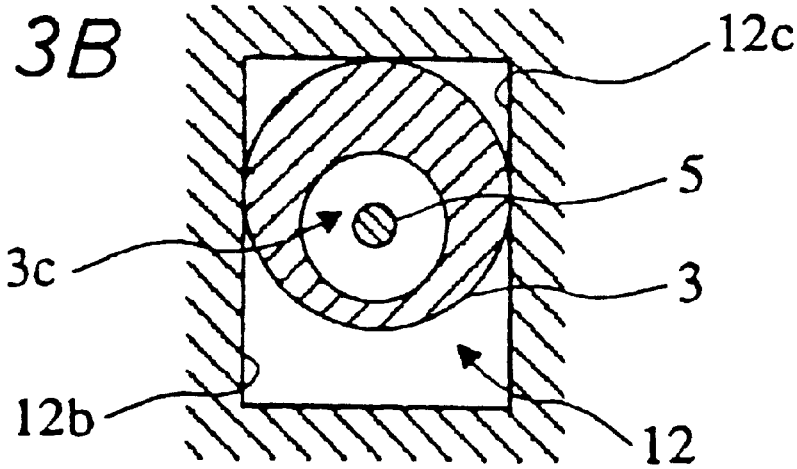
FIG. 3B is a sectional view showing a position of an eccentric cam in a cam guide.
Figure 3C:
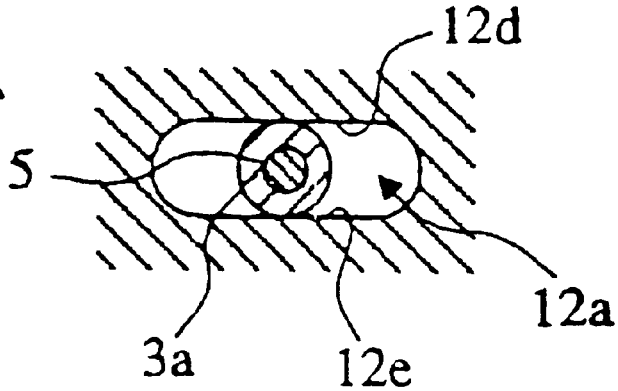
FIG. 3C is a sectional view showing a position of a shaft portion in a slot.
Figure 4A:
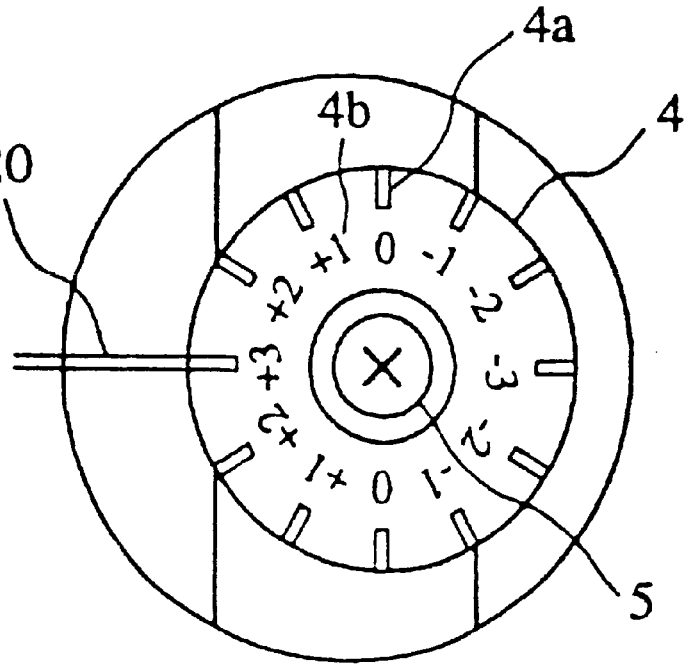
FIG. 4A is a plan view showing an amount of rotation of the adjusting dial.
Figure 4B:
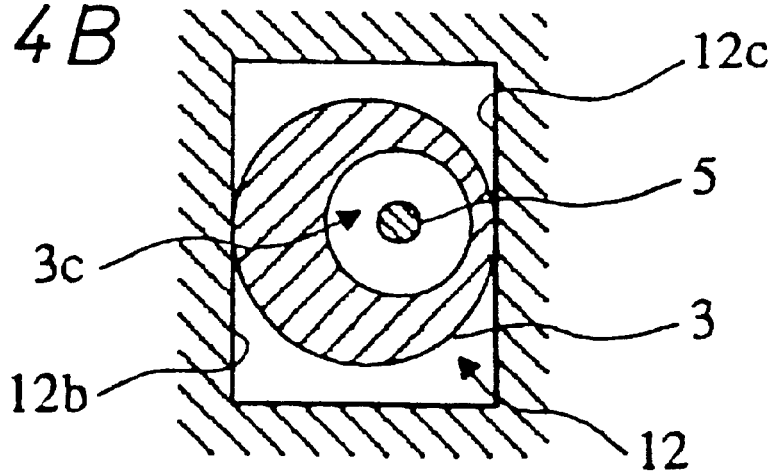
FIG. 4B is a sectional view showing a position of the eccentric cam in the cam guide.
Figure 4C:
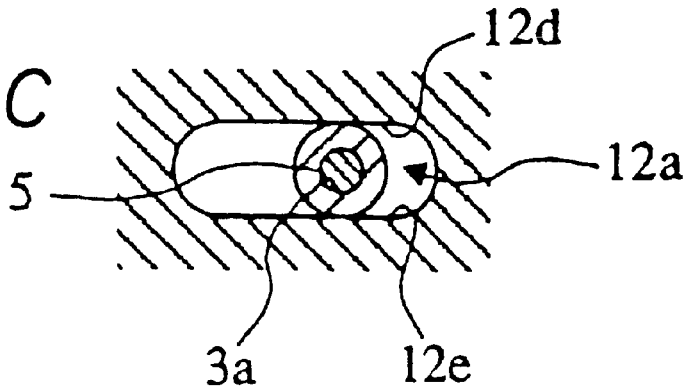
FIG. 4C is a sectional view showing a position of the shaft portion in the slot.
Figure 5A:
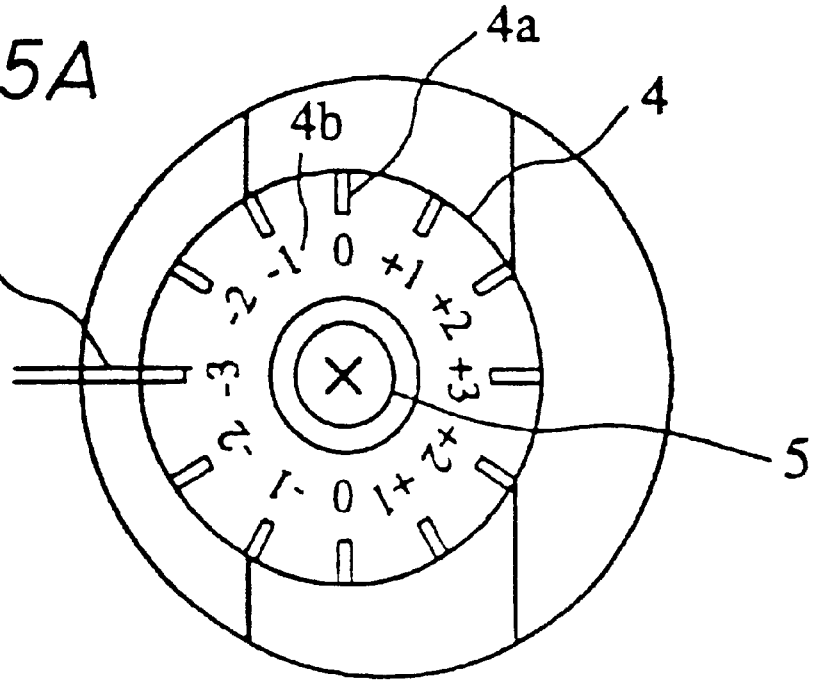
FIG. 5A is a plan view showing an amount of rotation of the adjusting dial.
Figure 5B:
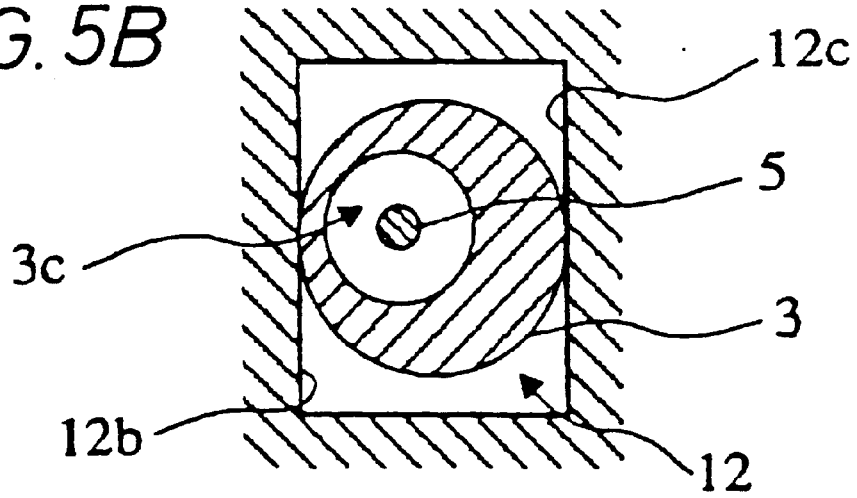
FIG. 5B is a sectional view showing a position of the eccentric cam in the cam guide.
Figure 5C:
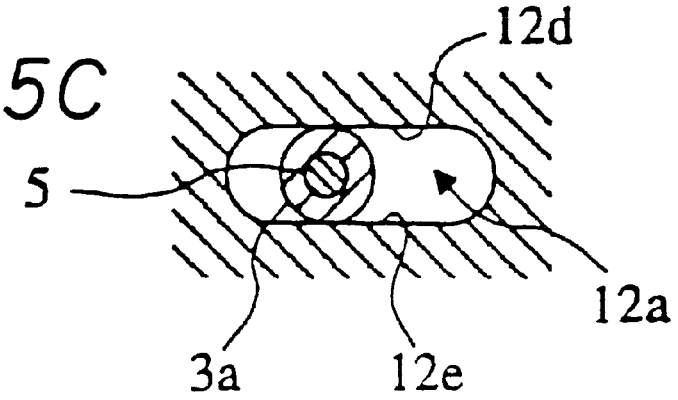
FIG. 5C is a sectional view showing a position of the shaft portion in the slot.

FIG. 3 illustrates an adjusting operation of the above adjusting section. FIGS. 3A, 4A and 5A are plan views showing amounts of rotation of the adjusting dial 4. FIGS. 3B, 4B and 5B are sectional views showing positions of the eccentric cam 3 in the cam guide 12. FIGS. 3C, 4C and 5C are sectional views showing positions of the shaft portion 3*a* in the slot 12*a*. As shown in FIGS. 3A, 4A and 5A, the adjusting dial 4 has, marked on an upper surface thereof, graduations 4*a* dividing the circumference into 12 equal parts, for example, and correction values 4*b* corresponding to the respective graduations 4*a*. As shown in FIGS. 3B, 4B and 5B, the eccentric cam 3 has a peripheral surface defined by a single circle having a diameter corresponding to a spacing between the side surfaces 12*b*, 12*c* of the cam guide 12 extending parallel in the second direction. Further, as shown in FIGS. 3C, 4C and 5C, the shaft portion 3*a* of the eccentric cam 3 has a diameter approximately corresponding to a spacing between side surfaces 12*d*, 12*e* of the slot 12*a* extending perpendicular to the second direction.

Thus, a peripheral surface of the shaft portion 3*a* are constantly in contact with the two side surfaces 12*d*, 12*e* of the slot 12*a*, and the shaft portion 3*a* and the set screw 5 are movable relative to the main body 11*a* only longitudinally of the slot 12, i.e. only in the first direction. Consequently, when the eccentric cam 3 is rotated with the adjusting dial 4 in the cam guide 12 to vary the positions of contact between the peripheral surface of the eccentric cam 3 and the side surfaces 12*b*, 12*c* of the cam guide 12, the center of the shaft portion 3*a* and the set screw 5 which serve as the center of rotation of the eccentric cam 3 shifts in the cam guide 12 only in the first direction, and not in the second direction.

With the adjusting section having the above construction, when one of the graduations 4*a* on the adjusting dial 4 is set to an index 20 marked on the upper surface of the main body 11*a*, the set screw 5 moves relative to the main body 11*a* in the first direction by the correction value 4*b* corresponding to the graduation 4*a*. That is, when, as shown in FIG. 3A, a graduation 4*a* corresponding to correction value 0 of the dial 4 is set to the index 20, the center of rotation of the eccentric cam 3 is at an equal distance to the side surfaces 12*b*, 12*c* of the cam guide 12 as shown in FIG. 3B, and the shaft portion 3*a* lies in approximately the middle position longitudinally of the slot 12*a* as shown in FIG. 3C.

When the adjusting dial 4 is turned from the state shown in FIG. 3A to set graduations 4*a* corresponding to correction values +1 to +3 on the adjusting dial 4 to the index 20, the center of rotation of the eccentric cam 3 is at a greater distance to the side surface 12*b* than to the side surface 12*c* of the cam guide 12, and the shaft portion 3*a* moves rightward from the middle position longitudinally of the slot 12*a*. As shown in FIGS. 4A–4C, when the graduation 4*a* corresponding to correction value +3 on the adjusting dial 4 is set to the index 20, the difference between the distances of the center of rotation of the eccentric cam 3 to the side surface 12*b* and to the side surface 12*c* of the cam guide 12 reaches a maximum, and the shaft portion 3*a* lies in an extreme rightward position longitudinally of the slot 12*a*.

When the adjusting dial 4 is turned from the state shown in FIG. 3A to set graduations 4*a* corresponding to correction values −1 to −3 on the adjusting dial 4 to the index 20, the center of rotation of the eccentric cam 3 is at a smaller distance to the side surface 12*b* than to the side surface 12*c* of the cam guide 12, and the shaft portion 3*a* moves leftward from the middle position longitudinally of the slot 12*a*. As shown in FIGS. 5A–5C, when the graduation 4*a* corresponding to correction value −3 on the adjusting dial 4 is set to the index 20, the difference between the distances of the center of rotation of the eccentric cam 3 to the side surface 12*b* and to the side surface 12*c* of the cam guide 12 reaches a maximum, and the shaft portion 3*a* lies in an extreme leftward position longitudinally of the slot 12*a*.

The correction values 4*b* marked on the adjusting dial 4 correspond to the amounts (mm) of movement of the shaft portion 3*a* from the longitudinally middle position in the slot 12*a*. The shaft portion 3*a* moves rightward or leftward from the longitudinally middle position in the slot 12*a* by the correction value 4*b* corresponding to one of the graduations 4*a* on the adjusting dial 4 set to the index 20. That is, the position of the shaft portion 3*a* in the slot 12*a* is shifted in the state shown in FIGS. 4A–4C by 3 mm rightward from the middle position shown in FIGS. 3A–3C, and in the state shown in FIGS. 5A–5C by 3 mm leftward from the middle position shown in FIGS. 3A–3C.

The adjusting dial 4 and the main body 11*a* have engaging members, not shown, to be engageable with each other. Thus, the adjusting dial 4 may be stopped in a rotational position where each graduation 4*a* is set to the index 20.

With the above construction, by turning the adjusting dial 4 which is disposed so as to be operated from the upper surface side of the main body 11*a*, to set one of the graduations 4*a* on the adjusting dial 4 to the index 20, the position of the pinion 10, which determines positions of the restricting members 1, 2 in the first direction, can be displaced, along with the shaft portion 3*a* of the eccentric cam 3, the set screw 5 and the boss 13*a*, by the correction value 4*b* corresponding to the graduation 4*a* set to the index 20, in the first direction.

Thus, the sheet feed position, i.e. the reference position, in the sheet mounting apparatus 11 can be adjusted easily and accurately only by measuring an error in the processing position, in the first direction, for a sheet fed from the sheet mounting apparatus 11 to the sheet processing apparatus, and turning the adjusting dial 4 to set to the index 20 the graduation 4*a* corresponding to the correction value 4*b* equal to the error measured.

The adjusting dial 4, not protruding from the upper surface of the main body 11*a*, does not contact the bottom of sheets placed on the sheet mount, thereby presenting no obstruction to sheet feeding.

The number of graduations 4*a* marked on the adjusting dial 4 is not limited to 12. The intervals between the correction values 4*b* corresponding to the graduations 4*a* are not limited to 1 mm, either.

Figure 6:
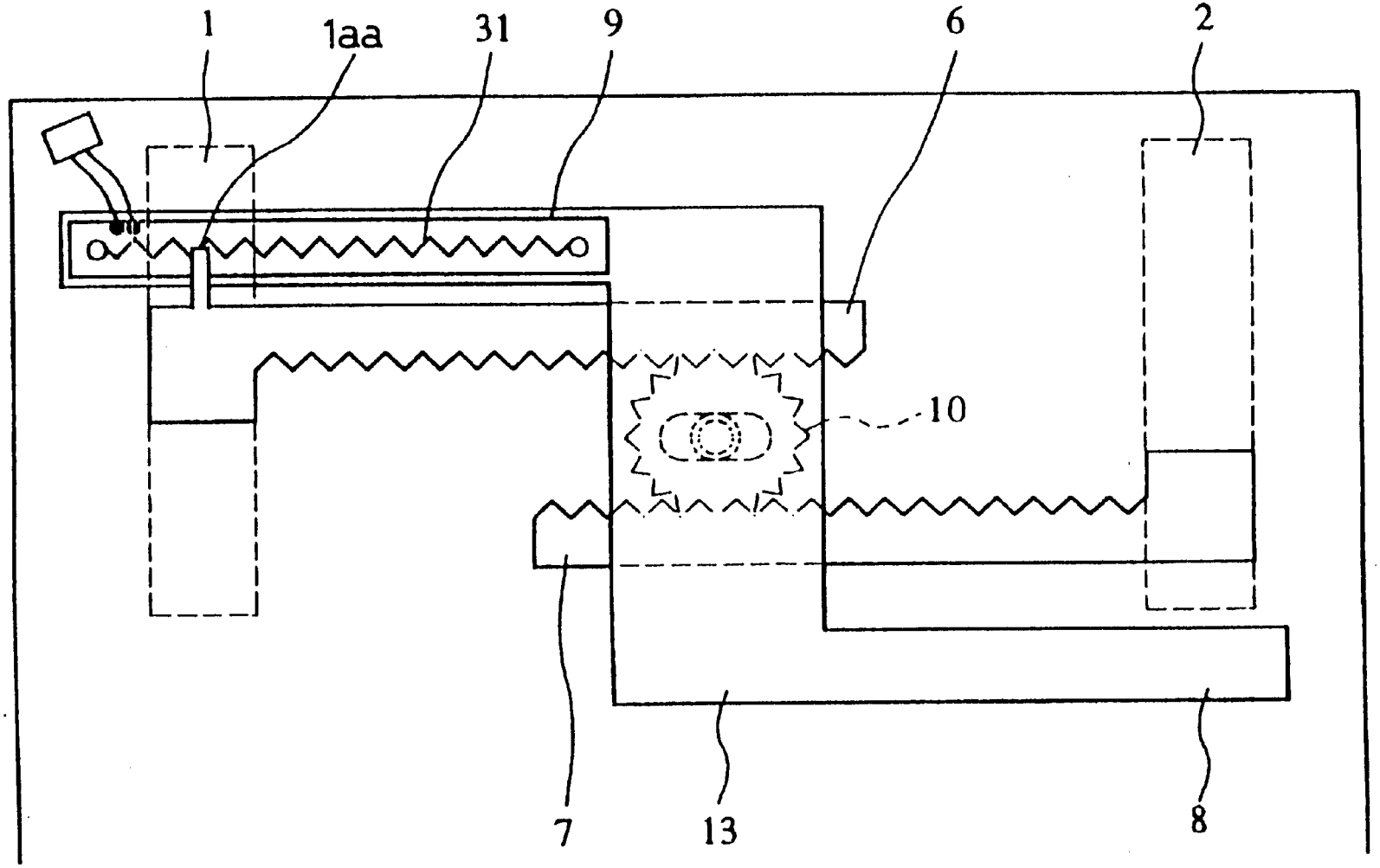
FIG. 6 is a bottom view of a portion of the sheet mounting apparatus.

FIG. 6 is a bottom view of a portion of the sheet mounting apparatus. With the retaining member 13 disposed adjacent the bottom of the main body 11*a*, a size indicator 8 and a size detector 9 are integrated. The size indicator 8 has graduations marked on an upper surface thereof for indicating one side of each size sheet extending parallel to the second direction (see FIG. 1). The upper surface of the size indicator 8 can be viewed from above the upper surface side of the main body 11*a* through the size display 15. By setting the mark 16 on the restricting member 2 to one of the graduations marked on the size indicator 8, in the size display 5, the positions of the restricting members 1, 2 in the first direction can be adjusted to the size of sheets to be fed.

The size detector 9 is in the form of a slide volume 31 engaged by a contact 1*aa* disposed on the restricting member 1. The size detector 9 outputs to the sheet processing apparatus an electric signal indicative of a position in the first direction to which the restricting member 1 has moved in accordance with the size of sheets placed on the sheet mounting apparatus 11. Based on the electric signal, the sheet processing apparatus recognizes the size of the sheets made available on the sheet mounting apparatus 11.

The size indicator 8 and the size detector 9 are integrated with the retaining member 13 as described above. Even when the reference position is adjusted in the first direction, and the arrangement of the restricting members 1, 2, namely the reference position, is shifted on the main body 11*a* in the first direction, with a movement of the pinion 10, the size indicator 8 and the size detector 9, along with the retaining member 13 supporting the pinion 10 in the boss 13*a*, move in the same direction and by the same amount as the restricting members 1,2. Consequently, after adjusting the reference position, the size indicator 8 can accurately indicate the position of the side of each size sheet, and the size detector 9 can accurately detect the size of the sheets placed on the sheet mounting apparatus 11.

Figure 7:
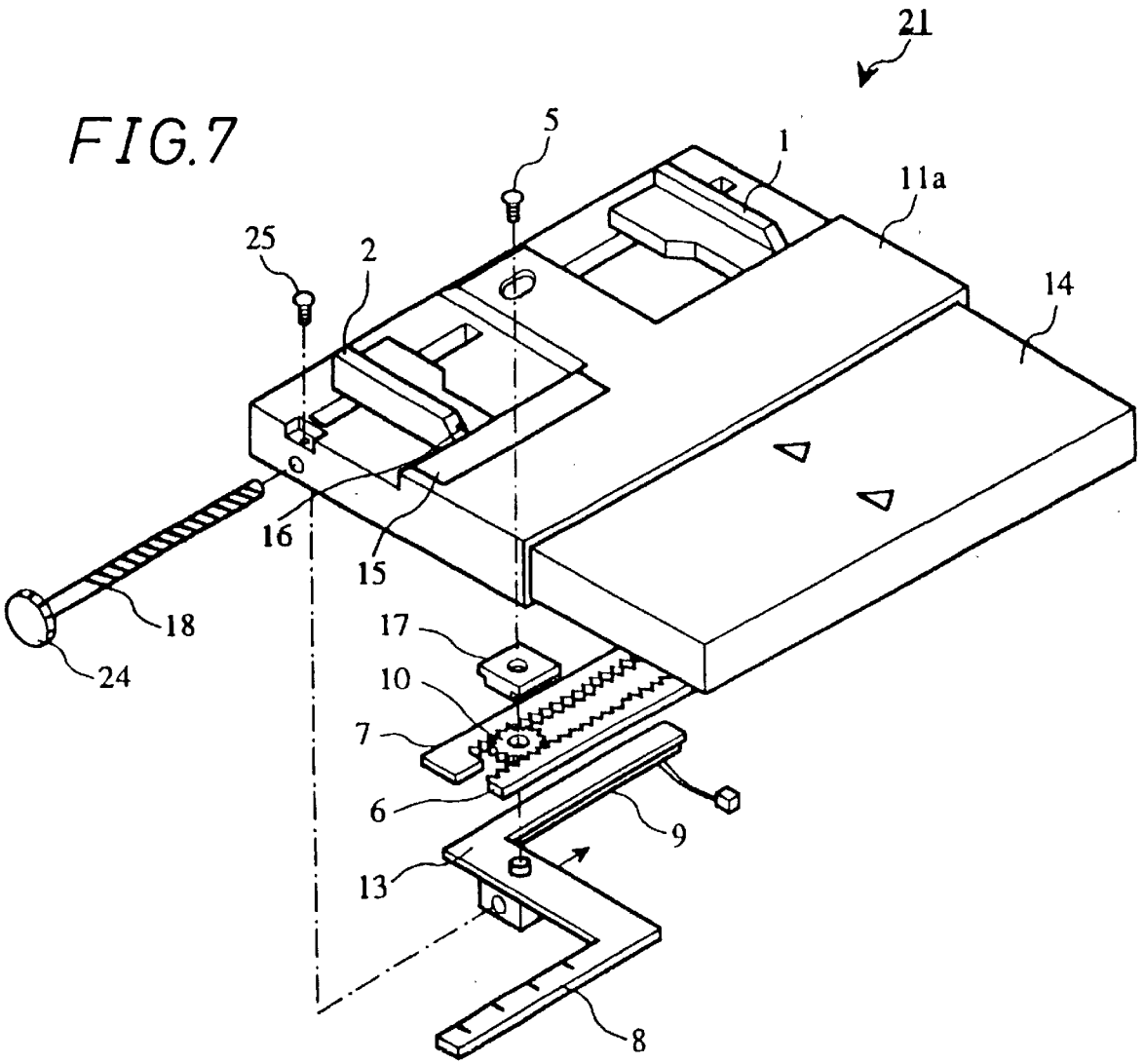
FIG. 7 is a perspective view of a sheet mounting apparatus in a second embodiment of the invention.

FIG. 7 is a perspective view of a sheet mounting apparatus in a second embodiment of the invention. The sheet mounting apparatus 21 in this embodiment differs from the sheet mounting apparatus 11 in the first embodiment shown in FIGS. 1–5 in that the eccentric cam 3 with the adjusting dial 4 integrated there with, and the cam guide 12, are now replaced with a slider 17, an adjusting screw 24 and a clamp screw 25. The other details are the same as in the sheet mounting apparatus 11 in the first embodiment.

Figure 8A:
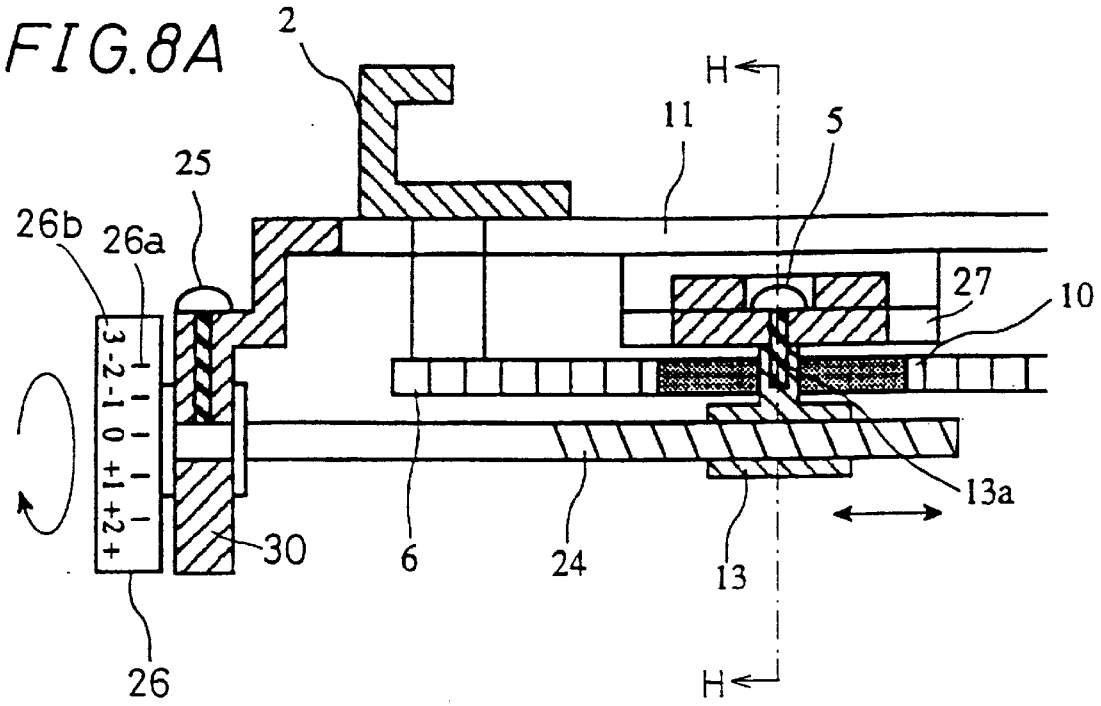
FIGS. 8A and 8B are fragmentary sectional views of an adjusting section in the above sheet mounting apparatus.
Figure 8B:
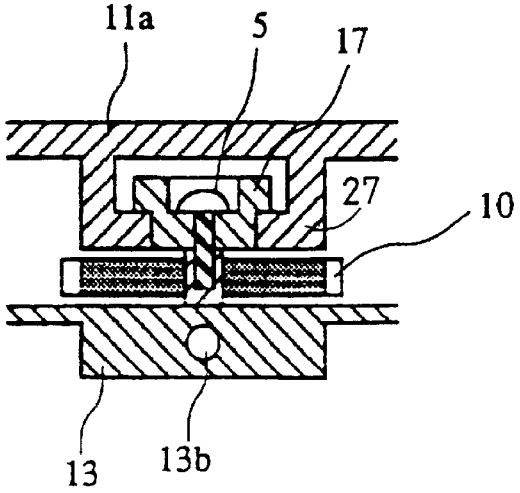

FIG. 8 shows sectional views of a portion of the above sheet mounting apparatus illustrating the adjusting section. FIG. 8A is a sectional view seen in the second direction. FIG. 8B is a sectional view taken on line H—H of FIG. 8A. The adjusting section of the sheet mounting apparatus 21 in this embodiment, as noted above, includes an adjusting screw 24 extending adjacent the bottom of the main body 11*a* in the first direction, through one side 30 parallel to the second direction, to be meshed with a threaded portion 13*b* of the retaining member 13, a clamp screw 25 for locking the adjusting screw 24 to a rotational position relative to the main body 11*a* and a slider 17 fixed to the boss 13*a* of retaining member 13 by the set screw 5. An adjusting dial 26, acting as a control member of the invention, is fixed to an end of adjusting screw 24 projecting from the side of the main body 11*a*. The adjusting dial 26 has graduations 26*a* marked circumferentially thereof and dividing the circumference into equal parts, and correction values 26*b* corresponding to the respective graduations 26*a*. The slider 17 is mounted in a slider guide 27 formed in the bottom of the main body 11*a* to be movable within a predetermined range in the first direction.

In this construction, when the clamp screw 25 is loosened, and the adjusting dial 26 is operated to rotate the adjusting screw 24, the retaining member 13 having the threaded portion 13*b* meshed with the adjusting screw 24 moves in a direction determined by the slider 17 fixed to retaining member 13 through the fixed screw 5, i.e. in the first direction. In the sheet mounting apparatus 21, as in the sheet mounting apparatus 11 in the first embodiment, the boss 13*a* of retaining member 13 extends through the center bore of the pinion 10 to rotatably support the pinion 10 which determines the positions of the restricting members 1, 2 in the first direction. Consequently, by turning the adjusting dial 26, the positions of the restricting members 1, 2 are shifted in the first direction.

Thus, the sheet feed position in the sheet mounting apparatus 21 can be adjusted easily and accurately only by measuring an error in the processing position, in the first direction, of a sheet fed from the sheet mounting apparatus 21 to the sheet processing apparatus, loosening the clamp screw 25, turning the adjusting dial 26 to set the graduation 26*a* corresponding to the correction value 26*b* equal to the error measured, to an index marked on the side surface of the main body 11*a*, and thereafter tightening the clamp screw 25.

Figure 9A:
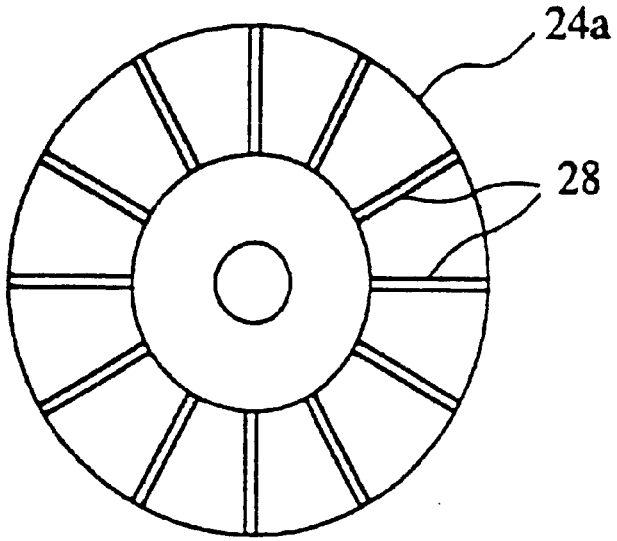
FIGS. 9A and 9B are views s showing a modified adjusting section in the above sheet mounting apparatus.
Figure 9B:
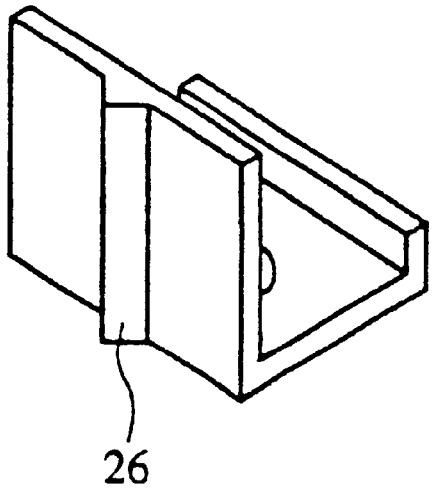

The clamp screw 25 may be replaced with engaging members for engaging the adjusting dial 26 and the main body 11*a* together, to stop the adjusting dial 26 in a rotational position where each graduation 26*a* is in register with the index. The engaging members may include grooves 28 formed in positions on an inward surface of adjusting dial 26 corresponding to the graduations 26*a* as shown in FIG. 9A, and a latch 29 attached to the main body 11*a*, as shown in FIG. 9B, for elastically engaging each groove 28. This construction is capable of easily and reliably stopping the adjusting dial 26 in a rotational position where each graduation 26*a* is in register with the index.

In each of the foregoing embodiments, the sheet mounting apparatus is the middle sheet feed reference type having a sheet feed reference position located at midpoint in the first direction. The invention is equally applicable to a sheet mounting apparatus of the side sheet feed reference type having a sheet feed reference position located adjacent one end in the first direction, as long as the restricting member adjacent the reference position is adapted movable with the pinion in the first direction relative to the main body.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet mounting apparatus comprising:

a main body for mounting a, variety of sizes sheets on a sheet mounting plane;

a restricting section movable to the main body in a first direction which is parallel to the sheet mounting plane of the main body and perpendicular to a second direction which is a sheet feeding direction, according to a size of sheets on the sheet mounting plane, for restricting movement of the sheets;

a reference position regulating section for regulating a reference position of the restricting section in the first direction; and an adjusting section for selectively moving the reference position regulating section to one of a plurality of positions in the first direction, wherein the reference position regulating section is a rotatable element rotatable with movement of the restricting section, and movable relative to the main body within a predetermined range in the first direction; and the adjusting section includes an eccentric cam which is supported coaxially with the rotatable element to be placed selectively in one of a plurality of rotational positions and has a peripheral surface contacting side surfaces of a cam guide formed in the main body, which side surfaces extend parallel to the second direction.

2. The sheet mounting apparatus of claim 1, wherein the adjusting section includes a control member which is disposed below an upper surface of a sheet mount of the main body so as to be operated from the upper surface side of the sheet mount, and fixed to an upper surface of the eccentric cam to be coaxial with the axis of rotation of the cam.

3. A sheet mounting apparatus comprising:

a main body for mounting a, variety of sizes sheets on a sheet mounting plane;

a restricting section movable to the main body in a first direction which is parallel to the sheet mounting plane of the main body and perpendicular to a second direction which is a sheet feeding direction, according to a size of sheets on the sheet mounting plane, for restricting movement of the sheets;

a reference position regulating section for regulating a reference position of the restricting section in the first direction; and an adjusting section for selectively moving the reference position regulating section to one of a plurality of positions in the first direction, wherein the reference position regulating section is a rotatable element rotatable with movement of the restricting section, and movable relative to the main body within a predetermined range in the first direction; and the adjusting section includes a screw meshed with a support portion of the rotatable element in the first direction to be placed selectively in one of a plurality of rotational positions.

4. The sheet mounting apparatus of claim 3, wherein the adjusting section includes a control member which is disposed so as to be operated from a side surface side of the sheet mount of the main body and fixed to one end of the screw to be coaxial with the screw.

5. The sheet mounting apparatus of claims 1 or 3, further comprising:

a size indicator movable in the same directly and by the same amount as those of the reference position regulating section, for indicating positions of ends of the sheets on a sheet mount of the main body in the first direction.

6. The sheet mounting apparatus of claims 1 or 3, further comprising:

a size detector movable in the same direction and by the same amount as those of the reference position regulating section, for detecting positions of the restricting section on a sheet mount of the main body in the first direction.

* * * * *